United States Patent [19]

Brugger et al.

[11] 4,430,172

[45] Feb. 7, 1984

[54] METHOD OF INCREASING CORROSION RESISTANCE IN GALVANICALLY DEPOSITED PALLADIUM/NICKEL COATINGS

[75] Inventors: Robert Brugger, Filderstadt; Klaus Schulze-Berge, Remscheid, both of Fed. Rep. of Germany

[73] Assignee: Langbein-Pfanhauser Werke AG, Fed. Rep. of Germany

[21] Appl. No.: 426,081

[22] Filed: Sep. 28, 1982

Related U.S. Application Data

[63] Continuation-in-part of Ser. No. 406,956, Aug. 10, 1982, abandoned.

[30] Foreign Application Priority Data

Sep. 11, 1981 [DE] Fed. Rep. of Germany ..... 3136003

[51] Int. Cl.[3] ..... C25D 3/56

[52] U.S. Cl. ..... 204/43 N

[58] Field of Search ..... 204/43 N, 123

[56] References Cited

FOREIGN PATENT DOCUMENTS 1143178 2/1969 United Kingdom ..... 204/43 N

*Primary Examiner*—G. L. Kaplan

*Attorney, Agent, or Firm*—Karl F. Ross; Herbert Dubno

[57] ABSTRACT

In a method of electrodepositing a palladium/nickel alloy coating upon a substrate wherein the coating is plated onto the substrate by electrodeposition from a bath containing 5 to 30 g per liter of palladium and 5 to 30 g per liter of nickel and having a palladium-nickel ratio such that the coating contains 30 to 90% by weight of palladium, the improvement which comprises providing in the bath during the eletrodeposition of the coating at least one sulfonyl urea compound capable of improving the corrision resistance of the coating.

9 Claims, No Drawings

METHOD OF INCREASING CORROSION RESISTANCE IN GALVANICALLY DEPOSITED PALLADIUM/NICKEL COATINGS

CROSS REFERENCE TO RELATED APPLICATIONS

This application is a continuation-in-part of Ser. No. 406,956 filed Aug. 10, 1982 (since abandoned) and is related to the commonly assigned copending application Ser. Nos. 355,245, 355,246 and 355,247, all filed Mar. 5, 1982.

FIELD OF THE INVENTION

Our present invention relates to a method of increasing the corrosion resistance of galvanically deposited palladium/nickel alloy coatings and to palladium/-nickel electrodeposition baths or plating compositions for use in the formation of such coatings.

BACKGROUND OF THE INVENTION

Palladium/nickel alloy coatings may be applied to conductive substrates for decorative and/or technological purposes, see the aforementioned copending applications. For example, such coatings are useful because they can be employed as a substitute for gold coatings and have an appearance similar to that of gold and corrosion resistance which can be significant.

As described in the aforementioned applications and in British Pat. No. 1,143,178, such coatings are generally deposited from a bath which is an aqueous solution of palladium and nickel. The palladium content of the bath is usually around 5 to 30 grams per liter and the nickel content is substantially 5 to 30 grams per liter as well, the bath containing sulfonic acid salts among other additives and the palladium/nickel ratio in the solution being selected so that the galvanically deposited or electroplated coating will contain 30 to 90% by weight palladium.

The resulting coating can be used, as noted, as a replacement for gold coatings since it has an appearance and decorative effect similar to that of gold and various properties, e.g. as a contact material for electrical contacts, which are also similar to those of gold. Thus, such coatings have an important role in electrotechnology.

The most important characteristic apart from high conductivity that a material thus suitable for use in electrotechnology must possess is a high resistance to corrosion of all types. In some cases the earlier palladium/nickel coatings did not have sufficient corrosion resistance.

In the electrodeposition of such coatings, moreover, it is known to add brighteners to the bath. Such brighteners have been aromatic sulfonic acids and their salts or other derivatives.

Typical of such brigteners are naphthalene sulfonic acid salts and aromatic sulfonamides such as the sodium salt of naphthalene-1,5-disulfonic acid, the sodium salt of naphthalene-1,3,6-trisulfonic acid, saccharin (o-sulfobenzoic acid imide) and p-toluenesulfonamide.

Reference may also be had in this connection to U.S. Pat. Nos. 4,010,084 and 4,102,755.

In the earlier palladium systems, there is occasionally a detrimental spontaneous salting out of palladium in the form of an insoluble salt, especially when the sodium salt of naphthalene-1,5-disulfonic acid is used, with a result that the coating has an unsatisfactory appearance and technological quality, especially when p-toluenesulfonamide is used as a brightener as well. Although the same problems do not also arise when the electrolyte contains the sodium salt of naphthalene-1,3,6-trisulfonic acid and/or saccharin as brighteners, sufficient corrosion resistance may be a problem in these cases.

Corrosion resistance can be conveniently measured, for the purposes of the present invention, by the immersion of test strips for 60 seconds at room temperature in a dilute acid solution consisting of equal parts of concentrated nitric acid and water.

When corrosion resistance is mentioned herein, therefore, such test conditions are employed.

German Patent No. 1,028,407 describes the use of specific brighteners for the galvanic deposition of bright nickel coatings, the brighteners being added to the bath in an amount of 0.1 to 1 gram per liter, preferably 0.5 grams per liter. The brightener compound, which has the same general formula as is given below, functions exclusively as a brightener, making no noticeable contribution to improvements in corrosion resistance. The brightening effect appears to be related to the urea group of this molecule which operates in a manner similar to earlier urea brighteners, the imine group of the molecule also having a brightening effect.

As far as we have been able to ascertain, such compounds have never been proposed as corrosion resistance promoters for palladium/nickel coatings or analogous deposits.

OBJECTS OF THE INVENTION

It is the principal object of our present invention to improve upon the corrosion resistance of electroplated palladium/nickel alloy coatings.

Another object of this invention is to provide an improved method of depositing a palladium/nickel coating with improved corrosion resistance.

Yet another object of this invention is to provide a plating bath adapted to produce a palladium/nickel coating with improved corrosion resistance.

DESCRIPTION OF THE INVENTION

We have now found, most surprisingly, that a brightener of the formula

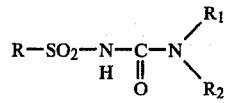

hitherto used exclusively as a brightener for a deposition of bright nickel coatings, when added in an amount of 0.1 to 10 g/liter of a bath for the deposition of palladium/nickel alloy coatings as previously described will greatly improve the corrosion resistance of the resulting coating. While any of the compounds of this formula described in German Patent No. 1,028,407 can effectively be used, in general, R should be an aromatic group, e.g. phenyl or naphthyl or substituted phenyl whose substituents are lower alkyl or amino. Nitrogen-containing heterocyclical moieties such as pyridino and morpholino may also be used for the moiety R, $R_1$ and $R_2$ may be the same or different and each can be selected from the group which consists of hydrogen, lower alkyl, lower alkyl substituted with amino and lower alkene or lower alkyne.

When the term "lower alkyl" is used herein it is intended thereby to include alkyl groups containing from 1 to 6 carbon atoms and in a straight or branched chain configuration.

The lower alkenes and lower alkynes can have 2 to 6 carbon atoms.

Preferably $R_1$ and $R_2$ are each hydrogen, methyl or ethyl and R is phenyl, hydroxyphenyl or tolyl.

The bath to which this brightener is added can be any of the baths described in the aforementioned copending applications for galvanically depositing (electroplating) palladium/nickel alloy coatings. In particular, the bath should contain an aqueous solution of palladium and nickel ammines with a palladium content of about 5 to 30 g/liter, a nickel content of 5 to 30 g/liter, one or more sulfonic acid salts in an amount of, say, 0.01 to 20 g/liter, conductivity promoting salts, e.g. in an amount of 10 to 200 g/liter, 0.01 to, say, 5 g/liter of a wetting agent and one or more sulfonyl ureas of the aforementioned formula in a total amount of 0.1 to 10 g/liter. The palladium/nickel ratio is set so that the electrodeposited coating contains 30 to 90% by weight of palladium.

For optimum corrosion resistance, the palladium/nickel coating should be applied in a thickness of 1 to 5μ, preferably 2.5μ and the corrosion resistance promoting additives should be used in an amount of 1 to 10 g/liter of the plating bath.

Surprisingly, the sulfonyl urea of the formula given, which functions only as a brightening additive in nickel-plating baths and which does not have a noticeable effect upon improvement of the corrosion resistance, in the special palladium/nickel bath of the invention functions as a corrosion resistance promoter leading to high-durability decorative and/or electrotechnical coating having unusually high corrosion resistance.

In fact, the coatings which result from the use of these compounds alone or in combination with aliphatic unsaturated and heterocyclic sulfonic acids and/or in combination with acetylene alcohol and/or acetylene amine and/or amino alcohols, results in palladium/nickel coatings which are practically free from long-term and short-term corrosion and which show no noticeable corrosion in the aforementioned tests.

The aliphatically unsaturated and heterocyclic sulfonic acids can be, as described in the aforementioned copending applications, one or more members of the group selected from sodium vinyl sulfonates, sodium allyl sulfonate, sodium propyne sulfonate, sodium methallyl sulfonate, N-pyridinium propyl sulfobetain, N-pyridinium methyl sulfobetain and the sodium salt of N-benzyl pyridinium-2-ethyl sulfonic acid.

The effect of the system of our invention appears to be quite different from the effect of the sulfonyl urea in nickel baths. In nickel baths the brighteners increase the ductility of the coating and reduce the tensile stresses in the bright nickel coatings which, as a rule, are thicker by a factor of 10 than the preferred coating of our invention. Our invention operates with additives in the bath far greater in number and in concentration than the additives in a bright nickel bath.

It appears that the improvement is a result of an electrochemical passivation at the coating surface. Naturally, care should be taken to prevent interference by metallic impurities.

Apart from the introduction of the additives of the invention, the palladium/nickel coating can be formed using the techniques described in the British Pat. No. 1,143,178 or the aforementioned copending applications.

The bath temperature is preferably room temperature (20° C.±20° C.) while the current density may range between 0.1 to 10 A/dm$^2$ and preferably is about 0.5 to 2 A/dm$^2$.

SPECIFIC EXAMPLES

The bath has the following composition:

20 g Pd as $[Pd(NH_3)_4]Cl_2$,
9 g Ni as $[Ni(NH_3)_6]SO_4$,
50 g Conductivity-promoting salt as $(NH_4)_2SO_4$, $NH_4OH$ sufficient to give a pH of 8.5,
3 g Na allylsulfonate,
2 g Benzenesulfonylurea

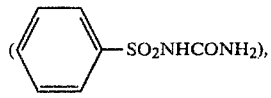

0.5 g Wetting agent (phosphoric acid ester), and
Water sufficient for 1 liter.

The palladium/nickel coating was deposited upon a copper substrate at a bath temperature of 35° C. with a current density of 1 A/dm$^2$ with agitation of the bath to form electrical contact having a thickness of 2μ.

When the coating was subjected to the above-described corrosion tests, no long-term corrosion was visible and even after such long-term testing, no noticeable change in contact resistance of the coating was observed.

When the same bath was used under the same conditions but without the sulfonyl urea, the contact element was found to corrode within a short time and to almost immediately develop a high contact resistance when subjected to the corrosion test.

Similar results were obtained when the bath of the present invention contained 5 to 20 g/liter of palladium as the palladium ammine fluoride, 5 to 15 g/liter of nickel as the nickel-ammine sulfate or as the nickel sulfamate $[Ni(SO_3NH_2)_2]$, 50 to 100 g of the conductivity promoting salt in the form of ammonium sulfate or ammonium hydroxide to provide a pH of 8.0 to 9.0, 1 to 10 g/liter of sodium allyl sulfonate, and 0.1 to 1 g of the wetting agent per liter.

We claim:

1. In a method of depositing a palladium/nickel alloy coating upon a substrate wherein the coating is galvanically deposited from an aqueous bath containing substantially 5 to 30 g/liter of palladium in the form of a palladium ammine, substantially 5 to 30 g/liter of nickel as nickel ammine, palladium and nickel in a ratio substantially equal to that of the coating to be formed and such that the coating contains 30 to 90% by weight palladium, the improvement which comprises increasing the corrosion resistance of said coating by incorporating therein at least one sulfonyl urea compound having the formula

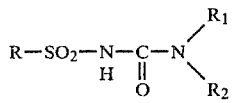

in an amount of 0.1 to 10 g/liter, wherein R is phenyl, tolyl, hydroxyphenyl, naphthyl or a nitrogen-containing heterocycle and $R_1$ and $R_2$ are the same or different and each is hydrogen or lower alkyl.

2. The improvement defined in claim 1 wherein the sulfonyl urea is benzene sulfonyl urea.

3. The improvement defined in claim 2 wherein said sulfonyl urea is present in an amount of 1 to 10 g/liter in said bath.

4. The improvement defined in claim 3 wherein said coating is electrodeposited to a thickness of 1 to 5μ.

5. The improvement defined in claim 4 wherein said thickness is about 2.5μ.

6. In an electroplating bath for the electrodeposition of a palladium/nickel coating which comprises an aqueous solution containing 5 to 30 g/liter each of palladium and nickel in the form of respective ammines with the palladium and nickel in a ratio corresponding to the composition of the coating deposited and such that the coating contains 30 to 90% by weight palladium, the improvement which comprises 0.1 to 10 g/liter of a sulfonyl urea in said solution, said sulfonyl urea having the formula

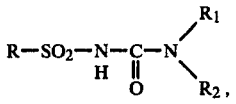

wherein R is phenyl, tolyl, hydroxyphenyl, naphthyl or a nitrogen-containing heterocycle and $R_1$ and $R_2$ are the same or different and each is hydrogen or lower alkyl.

7. The improvement defined in claim 6 wherein the sulfonyl urea is a benzene sulfonyl urea.

8. The improvement defined in claim 7 wherein $R_1$ and $R_2$ are each hydrogen.

9. A method of promoting corrosion resistance in an electroplating bath for depositing a palladium/nickel coating which comprises adding an effective amount of a sulfonyl urea of the formula

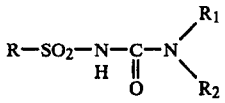

wherein R is phenyl, tolyl, hydroxyphenyl, naphthyl or a nitrogen-containing heterocycle and $R_1$ and $R_2$ are the same or different and each is hydrogen or lower alkyl to the plating bath.

* * * * *